US009526935B2

(12) United States Patent
Kadoche

(10) Patent No.: US 9,526,935 B2
(45) Date of Patent: Dec. 27, 2016

(54) DRY VISOR INTENDED TO BE MOUNTED IN A FIRE PROTECTION INSTALLATION OF THE TYPE COMPRISING A NETWORK OF VACUUM SPRINKLERS

(71) Applicant: VACTEC, Saint Florent sur Cher (FR)

(72) Inventor: Maurice Kadoche, Coubron (FR)

(73) Assignees: VACTEC, Saint Florent sur Cher (FR); Maurice Kadoche, Coubron (FR)

( * ) Notice: Subject to any disclaimer, the term of this patent is extended or adjusted under 35 U.S.C. 154(b) by 0 days.

(21) Appl. No.: 14/769,718

(22) PCT Filed: Feb. 13, 2014

(86) PCT No.: PCT/FR2014/050284
§ 371 (c)(1),
(2) Date: Aug. 21, 2015

(87) PCT Pub. No.: WO2014/128387
PCT Pub. Date: Aug. 28, 2014

(65) Prior Publication Data

US 2015/0375024 A1 Dec. 31, 2015

(30) Foreign Application Priority Data

Feb. 21, 2013 (FR) ..... 13 51518

(51) Int. Cl.
*A62C 37/08* (2006.01)
*A62C 35/68* (2006.01)
(Continued)

(52) U.S. Cl.
CPC ..... *A62C 35/68* (2013.01); *A62C 31/02* (2013.01); *A62C 35/62* (2013.01); *A62C 37/12* (2013.01); *A62C 37/14* (2013.01); *A62C 3/004* (2013.01)

(58) Field of Classification Search
CPC ..... A62C 37/08; A62C 37/10; A62C 37/11; A62C 37/12; A62C 37/14; A62C 37/16; A62C 31/00; A62C 31/02; A62C 3/002; A62C 3/004; A62C 35/62; A62C 35/64; A62C 35/645; A62C 35/68
(Continued)

(56) References Cited

U.S. PATENT DOCUMENTS

2009/0211772 A1 8/2009 Silva, Jr.

FOREIGN PATENT DOCUMENTS

KR 20120098205 A 9/2012

OTHER PUBLICATIONS

International Search Report and Written Opinion dated Oct. 28, 2014 for corresponding International Application No. PCT/FR2014/050284, filed Feb. 13, 2014.
(Continued)

*Primary Examiner* — Christopher Kim
(74) *Attorney, Agent, or Firm* — David D. Brush; Westman, Champlin & Koehler, P.A.

(57) ABSTRACT

A dry riser intended to be mounted in a fire protection installation, of the type including a network of vacuum sprinklers. The riser includes an elongate body having, at one of its ends, a connecting piece for coupling to piping, the connecting piece including a first nozzle capable of making a connection between the riser and the piping. The riser includes a shutoff member for shutting off the first nozzle. The other end of the riser bears a sprinkler. A connection is provided between the shutoff member that shuts off the first nozzle and a shutoff member that shuts off the nozzle of the sprinkler. The connection is configured to move in such a way as to cause a shutting-off position of the shutoff member of the sprinkler nozzle to coincide with a shutting-off position of the shutoff member that shuts off the first nozzle.

8 Claims, 2 Drawing Sheets

(51) Int. Cl.

| | |
|---|---|
| ***A62C 31/02*** | (2006.01) |
| ***A62C 35/62*** | (2006.01) |
| ***A62C 37/14*** | (2006.01) |
| ***A62C 37/12*** | (2006.01) |
| *A62C 3/00* | (2006.01) |

(58) Field of Classification Search
USPC ..... 169/37, 90, 38, 39, 40, 41, 17; 239/109, 239/110, 111
See application file for complete search history.

(56) References Cited

OTHER PUBLICATIONS

English translation of the Written Opinion dated Aug. 21, 2015 for corresponding International Application No. PCT/FR2014/050284, filed Feb. 13, 2014.

DRY VISOR INTENDED TO BE MOUNTED IN A FIRE PROTECTION INSTALLATION OF THE TYPE COMPRISING A NETWORK OF VACUUM SPRINKLERS

CROSS-REFERENCE TO RELATED APPLICATIONS

This Application is a Section 371 National Stage Application of International Application No. PCT/FR2014/050284, filed Feb. 13, 2014, the content of which is incorporated herein by reference in its entirety, and published as WO 2014/128387 A2 on Aug. 28, 2014, not in English.

FIELD OF THE DISCLOSURE

The field of the invention is that of designing and manufacturing firefighting equipment and installations. More precisely, the invention relates to devices designated by the term "dry riser", intended in particular for firefighting inside cold rooms.

BACKGROUND OF THE DISCLOSURE

The role of an automatic fire extinguishing installation implementing sprinklers is to detect, as early as possible, the seat of a fire then to automatically trigger the extinction system, at least locally, this while emitting an alarm. The installation has for objective to contain the fire as much as possible, before the arrival of the fire brigade which then takes over the installation in order to extinguish the fire.

In the field of the invention, firefighting installations are classified into three categories, namely:

"wet-pipe" systems;

"dry-pipe" systems;

"vacuum" systems.

In these three systems, the sprinklers are mounted in a network in such a way as to be distributed evenly over the site to be protected. Conventionally, the sprinklers comprise:

- a fixing connector, that allows the sprinkler to be connected to pipework, with this fixing connector having a nozzle intended for the passage of water to be released in order to extinguish the fire;
- a fusible member;
- a shutoff member for shutting off the nozzle, held in the shutoff position by the fusible member.

The fusible member is calibrated to blow when a certain temperature has been exceeded, as such releasing the nozzle from its shutoff member.

In "wet-pipe" systems, the entire piping of the installation is filled with water, and this up to the sprinklers. The water is therefore on standby behind the shutoff means and when the fusible member blows, the water flows through the nozzle of the connector of the sprinkler of which the fusible member has blown.

The release time for the water is therefore immediate, which is particularly advantageous. On the other hand, "wet-pipe" systems, are not adapted for sites that have risks of freezing. Indeed, in case of freezing, the water cannot flow. In addition, the freezing can cause deteriorations to the piping of the installation (deformation and even bursting of the pipes). In certain cases, the installation is emptied of water. In other cases, the site to be protected is heated in order to prevent any risk of freezing. For sites to be protected that have a relatively substantial surface area, the consumption of energy, and consequently the heating bill, can be substantial, and even prohibitive. Another way to fight freezing is to add an antifreeze agent to the water of the installation, such as glycol which is a toxic and carcinogenic product.

In the "dry-pipe" systems, the entire installation is emptied of water. The entire piping of the installation is kept under pressure. When the fusible members blow, the air pressure is released by the sprinkler or sprinklers in question and the water, also under pressure, tends to "push" the air outside of the installation until it arrives at the orifice or orifices released in such a way as to escape through the latter.

With such a system, the water can in certain cases take up to 60 seconds to reach the sprinkler of which the fusible member is blown, which is of course compliant with the current standard but which can be excessively long with regards certain incipient fires.

In addition, "dry-pipe" systems do not entirely overcome the problems linked to freezing. Indeed, condensation can be created in the piping of a "dry-pipe" installation, which can damage certain components of the installation and cause the protection to fail.

Generally, "wet-pipe" and "dry-pipe" systems have the following disadvantages:

- they are subject to forming slush and, consequently, to clogging;
- they are subject to corrosion, which can obviously lead to an installation partially or entirely out of use and cause the protection to fail;
- they can be the object of water leaks that cannot be seen;
- they allow the development of microorganisms in the pipes of the installation.

This results in that they require, among other things, antifreeze and anticorrosion treatments (involving recourse to harmful products).

Moreover, they require rinsing operations after use.

Furthermore, they imply putting into service times that are relatively long, according to the extent of the installation, which can range from one to four hours for "wet-pipe" systems and two hours and more for the "dry-pipe" systems.

In order to overcome all of these disadvantages, "vacuum" systems were designed. In "vacuum" systems, a vacuum is created in the pipes extending between a general valve and all of the sprinklers. In other terms, all of the pipes separating the valve from the sprinklers are in a vacuum.

In these systems, the vacuum constitutes an active energy which is used as a functional source in monitoring sprinklers. Indeed, if a fusible member of one of the sprinklers blows, the atmospheric pressure reaches the entire installation, which causes a change in the state of an actuator which, in turn, opens the general water inlet valve. Then the water quickly and without any obstacle invades the entire installation until the sprinklers, with the water flowing through the sprinkler or sprinklers of which the fusible member has blown. The vacuum which is still active in the networks quickly attracts the extinguishing water towards the sprinklers of which the fusible member has blown.

The triggering time of the actuator is very short, in that, when a fusible member blows, the "vacuum" installation immediately generates an aspiration phenomenon of the air outside of the installation. Note that this aspiration can be beneficial, as the aspiration effect on the seat of the fire tends to reduce the intensity of the latter.

The time for the water to arrive at the sprinkler of which the fusible member has blown is less than 60 seconds.

It is therefore understood that, due to the absence of water or of condensation in a "vacuum" system installation, the following results are obtained:

no corrosion, therefore no slush forming or clogging;

the guarantee of obtaining the density of extinguishing water required;

no development of microorganisms;

no water leaks possible (as the water is by default absent in the pipes of the installation that lead to the sprinklers);

no need for antifreeze agent or anticorrosion treatment;

no rinsing required before the installation is put into service.

For certain installations, it is necessary to plan for the implementation of dry risers, used for fighting a fire that can break out in a cold room.

These dry risers provide the connection between a pipe of the network of "vacuum" sprinklers and the inside of the cold room. For this, the dry risers have an elongate body having at one of its ends a connecting piece for coupling to pipework and, at the other of its ends, a sprinkler of the type of that described hereinabove.

The height of the elongate body is sized according to the thickness of the thermally insulated wall of the ceiling of the cold room.

Of course, this size of the elongate body is such that the sprinkler borne by the lower end of the dry riser extends into the internal volume of the cold room.

The design of dry risers is provided in such a way that, when the network of sprinklers is filled with water, the dry risers for which the fusible members have not blown are not filled with water. Indeed, even after the network of sprinklers is placed in a vacuum, water could stagnate in the elongate body of a riser and, in light of the temperature in the cold room, would freeze. This would result in a failure of the riser in the situation of a fire inside the cold room for one and/or the other of the following reasons:

the atmospheric pressure cannot extend in the network of sprinklers due to the ice present in the elongate body impeding the penetration of ambient air of the cold room;

the water cannot flow through the sprinkler, also due to the ice present in the elongate body partially or entirely impeding the flow of water.

In order to prevent this situation, dry risers include means of shutting off the connection, constituted by a first nozzle, between the riser and the pipework that bears it.

According to the operation of this dry riser, if the fusible member of the sprinkler of the riser blows, the shutoff valve on the sprinkler is ejected, which drives the displacement of the shutoff means on the first nozzle, in such a way as to release the communication between the riser and the pipework bearing the riser.

On the other hand, if the fusible member of the sprinkler of the riser does not blow, the shutoff means on the first nozzle remain in shutoff position and isolate the riser from the water present in the network of sprinklers.

However, according to the design of current risers and the corresponding maintenance practices, when the sprinkler of a dry riser has been triggered, the latter is entirely replaced.

As the cost of a single dry riser is relatively substantial, this maintenance practice is particularly expensive when it is a question of replacing all of the dry risers of a cold room.

Moreover, the sprinklers present at the mower end of the dry risers, as with all the other sprinklers of a "vacuum" network, comprise, in addition to the fusible member and the shutoff member, means for ejecting the shutoff member.

Indeed, as indicated hereinabove, when a fusible member blows, this results in an aspiration phenomenon of the air towards the inside the pipework of the installation. The shutoff member, if it is not forced to leave its location, remains somewhat "glued" on the mouth of the nozzle of the connector, which then does not allow the air to enter and consequently prevents the actuator from being triggered.

In order to prevent this, means for ejecting are mounted on each sprinkler. These means for ejecting are conventionally constituted of a spring inserted into a cylindrical part mounted in the nozzle of the sprinkler. An end of the spring is bearing against the bottom of the cylindrical part, while the other spring end is bearing against the shutoff valve held in position by the fusible member. The spring is of course in compressed state.

With such sprinklers, undesirable situations have sometimes been observed.

Indeed, it was observed that after blowing of the fusible member, the shutoff valve can remain in a partial shutoff position of the nozzle of the connector or in a position that hinders the proper distribution of the water. In any case, the spring is not ejected from the nozzle and therefore remains inside the latter.

This results in that, in any case, the nozzle is not entirely released, which forms a partial obstacle to the intake of air in the network. The consequence is that the vacuum of the installation is slowed down and, consequently, the triggering of the actuator is delayed, which can reach 30 to 40 seconds.

SUMMARY

An exemplary embodiment of the present disclosure relates to a dry riser intended to be mounted in a firefighting installation, of the type comprising a network of vacuum sprinklers, with the riser comprising an elongate body having at one of its ends a connecting piece for coupling to pipework, including a first nozzle able to provide the connection between the riser and the pipework, with the riser including means for shutting off the first nozzle; with the other end bearing a sprinkler comprising:

a fixing connector, by the intermediary of which the sprinkler is coupled to the body of the riser, with the fixing connector having a second nozzle;

a fusible member;

a shutoff member for shutting off the second nozzle, held in the shutoff position by the fusible member;

means for ejecting the shutoff member, characterised in that it comprises means of connection between the shutoff means that shut off the first nozzle and the shutoff member that shuts off the second nozzle, with said means being mobile in such a way as to cause the shutting-off position of the shutoff member to coincide with the shutting-off position of the first nozzle, the fixing connector of the sprinkler is made integral with an end section of the body having means for evacuating water comprising an inclined duct, rising towards the outside of the end section, and including a ball that can allow the water to flow in the bottom position in the inclined duct and prevent the water from flowing in the top position in the inclined duct.

As such, with a riser according to the invention, when the latter must be put back into service after the fusible member of the sprinkler of the riser has blown, it is not necessary, contrary to prior art, to replace the entire riser.

Indeed, with a riser according to the invention, it is possible to replace only the sprinkler, and even only the fusible member of the sprinkler.

As it shall appear more clearly in what follows, the putting back into place of a sprinkler with a new fusible member will act on the means of connection between the shutoff means that shut off the first nozzle and the shutoff member that shuts off the second nozzle, in such a way that the means for shutting off the first nozzle are automatically in service once the new sprinkler is installed.

It is understood that when changing only the sprinklers, and even only the fusible members of the sprinklers, relatively substantial gains can be obtained on maintenance costs.

Furthermore, with a riser according to the invention, the maintenance operations can be executed easily and very quickly.

In addition, the means for evacuating water are provided, as shall be explained in more detail in what follows, in order to evacuate the water introduced into the elongate body of the dry riser due to slight leaks.

Furthermore, thanks to their structure, the means for evacuating water are simple and act effectively and naturally according to the quantity and the water pressure in the dry riser, and this in the following way:

- in the absence of pressure, the ball will remain at the bottom of the inclined duct under the simple effect of gravity and the water present in the elongate body, a priori in the form of droplets (due to slight leaks), will flow through this duct, preventing it from accumulating and freezing inside the riser;
- in case of the presence of water in quantity and under pressure in the riser, the water pushes the ball towards the top of the duct, shutting off the latter, and favouring the exclusive flow of the water through the sprinkler for which the fusible member has blown.

According to an advantageous solution, the means for connecting include a shaft, with the body of the riser including means for guiding said shaft in longitudinal translation.

In this case, the means for shutting off the first nozzle are advantageously secured with an end of said shaft.

Furthermore, the means for guiding preferably comprise at least one intermediate part between two sections of the body of the riser, with the part being punched and having central slide inside of which the shaft is guided in translation.

As such, the guiding in translation of the connection shaft is provided, and this while producing a dry riser constituted of the assembly of spare parts that are simple in design and inexpensive to produce.

Preferentially, at least one spring is mounted between a means for stopping on the shaft and the intermediate part, with the mounting of the spring being carried out in such a way that the spring is in compression in the shutoff positions of the shutoff member and means for shutting off the first nozzle.

Such a mounting will contribute to the reactivity of the dry riser in case the latter is triggered due to the blowing of the fusible member of its sprinkler.

In addition, the shaft advantageously bears a stop intended to bear against an intermediate part and to retain the shaft when the shutoff member and the means for shutting off the first nozzle are not in shutoff position.

According to a particular embodiment, said end section is connected to another section of the body by a punched intermediate part and having a central slide inside of which the shaft is guided in translation. In this way, two different guiding zones of the connection shaft inside the elongate body of the dry riser can be obtained.

According to another advantageous characteristic of the invention, the means for ejecting the shutoff member from the sprinkler are mounted outside the second nozzle and act in a pulling sense on the shutoff member.

As such, thanks to this characteristic, after the blowing of the fusible member of a sprinkler of a dry riser according to the invention, the complete release of the nozzle from the sprinkler in question is obtained.

Indeed, two characteristics of the invention are combined in order to obtain this particular advantageous result, namely:

- the fact that the spring is mounted outside the nozzle, and therefore is not in a position to hinder the intake of air into the pipework of the installation;
- the spring acts in a pulling sense on the shutoff member, which provides for its extraction and its ejection from the sprinkler.

BRIEF DESCRIPTION OF THE DRAWINGS

Other characteristics and advantages of the invention shall appear more clearly when reading the following description of a preferred embodiment of the invention, given by way of a simple example for the purposes of information and non-restricted, and of the annexed drawings among which.

DETAILED DESCRIPTION OF ILLUSTRATIVE EMBODIMENTS

Figure 1:
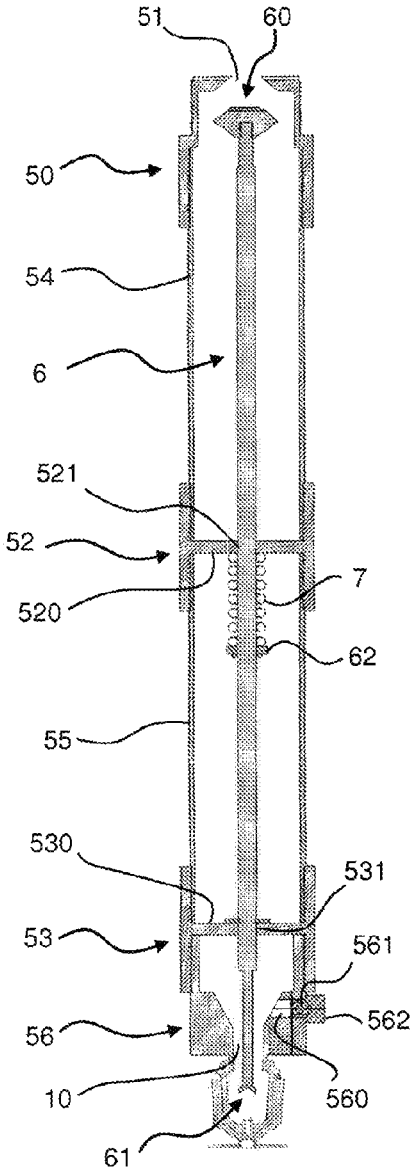
FIG. 1 diagrammatically shows as a longitudinal cross-section a dry riser according to the invention, in its triggered configuration.
Figure 2:
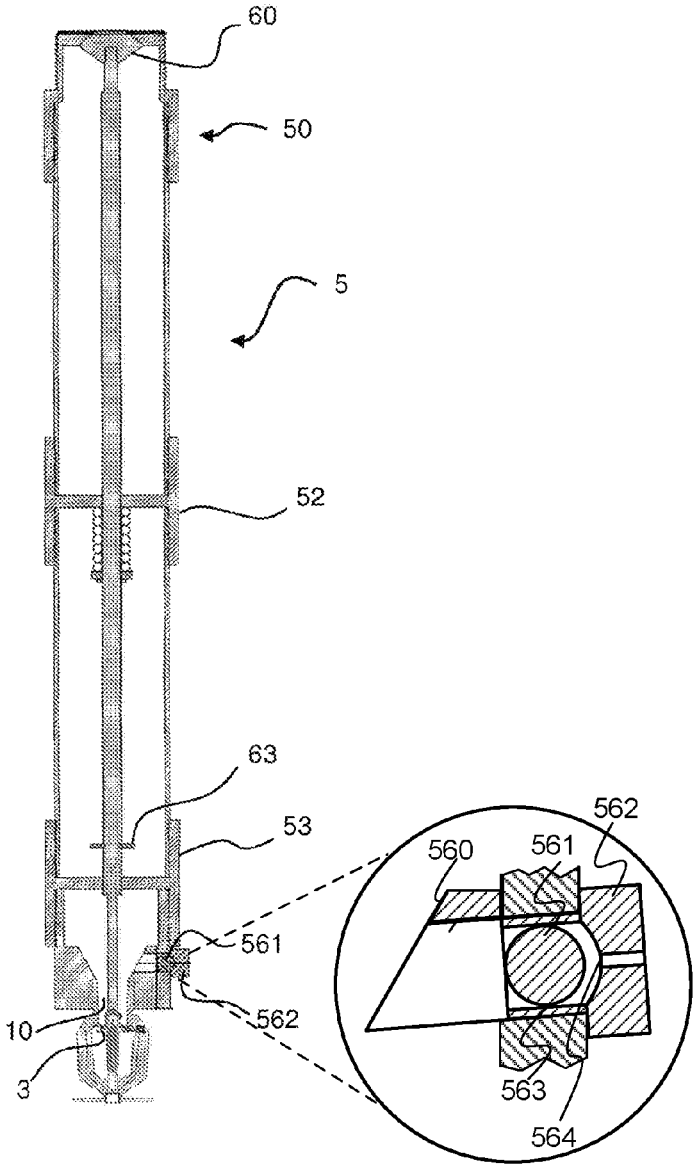
FIG. 2 diagrammatically shows as a longitudinal cross-section a dry riser according to the invention, in its service configuration.
Figure 3:
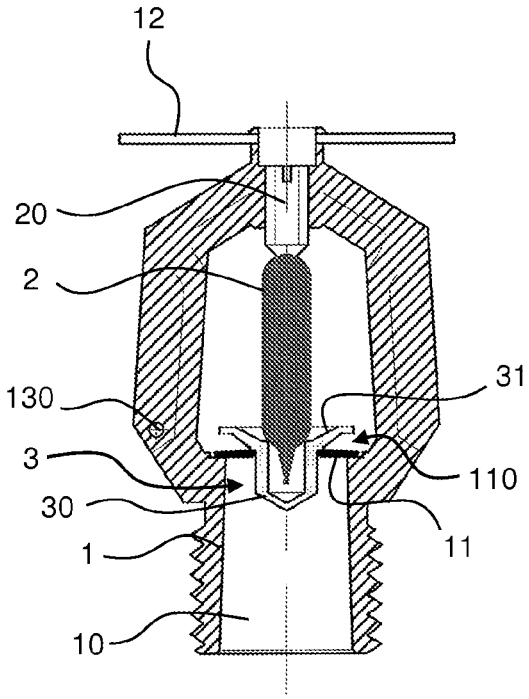
FIGS. 3 and 4 diagrammatically show a sprinkler according to a first embodiment of the invention, respectively as a cross-section view and as a side view.

Such as shown in FIGS. 1 and 2, a dry riser according to the invention comprises a body 5 having:

- a connecting piece 50 at one of its ends;
- a sprinkler at the other of its ends.

The connecting piece 50 is intended to allow the connecting of the dry riser to pipework, and includes in order to do this a first nozzle 51 able to provide the connection between the riser and the pipework. The dry riser furthermore includes means 60 for shutting off this first nozzle 51, with these means for shutting off being mobile between a shutoff position of the nozzle 51 (FIG. 2) and a released position of the nozzle 51 (FIG. 1).

The sprinkler borne by the dry riser according to the invention is of the type comprising:

- a fixing connector 1, presenting an external thread making it possible to screw the latter on a pipework having a complementary thread, for the purpose of connecting the sprinkler to the pipework, with the connector having a second nozzle 10 intended to communicate with the inside of the pipework;
- a fusible member 2, constituted in practice by an ampoule enclosing a liquid and an air bubble provided, according to the conventional technique of fusible members used on sprinklers, to expand and cause the bursting of the ampoule if the temperature to which the fusible member is subjected exceeds a predetermined threshold;
- a shutoff member 3 for shutting off the second nozzle 10;

a deflector 12 fixed on a yoke 13 made integral with the connector 1 of the sprinkler.

The fusible member 2 bears, by one of its ends, on the shutoff member 3 in such a way as to maintain the second nozzle in its shutting-off position, with the other end of the fusible member bearing against a lug 20 integral with the yoke and, here, with the deflector 12 (with the lug 20 being in practice also a means of fastening by screwing of the deflector on the yoke).

In the standby position of a riser such as shown in FIG. 2, the fusible member 2 bears, by one of its ends, on the shutoff member 3 in such a way as to maintain the second nozzle 10 in its shutting-off position, with the other end of the fusible member bearing against a lug 20 integral with the yoke and, here, with the deflector 12 (with the lug 20 being in practice also a means of fastening by screwing of the deflector on the yoke).

According to the principle of the invention, the dry riser comprises means of connection 6 between the shutoff means 60 that shut off the first nozzle 51 on the one hand, and on the other hand, the shutoff member 3 that shuts off the second nozzle 10, with these means of connection being mobile in such a way as to cause the shutting-off position of the shutoff member 3 to coincide with the shutting-off position of the shutoff means 60 of the first nozzle 51.

According to this embodiment, the means of connection 6 comprise a shaft extending inside the elongate body of the riser, and on the end of which are secured the shutoff means 60 for shutting off the first nozzle 51.

The end of the shaft constituting the means of connection and provided with a thread, and the shutoff means 60 are comprised of a head having a bore, in such a way that the head of the shutoff means is screwed to the corresponding end of the shaft.

At its other end, the shaft has a cup 61 intended to bear, as shown in FIG. 2, against the base 30 of the shutoff valve 3.

Inside the elongate body 5, the shaft of the means for connecting is guided in longitudinal translation, and this using means for guiding that comprise, such as shown in FIGS. 1 and 2, two intermediate parts 52, 53. Each one of these intermediary parts is punched inside the body of the riser, and has a bearing branch 520, 530 having at its middle a slide 521, 531 inside of which the shaft of the means of connection 6 is guided in translation.

Note that the elongate body 5 of the riser is constituted by the assembly of the following parts:

- two tubular sections 54, 55 connected by screwing using one of the intermediary parts 52 substantially at mid-height of the elongate body;
- the connecting piece 50, screwed at the end of the section 54;
- the intermediary part 53, connecting the section 55 with an end section 56 also forming a means of connection with the fixing connector 1 of the sprinkler.

Such as shown in FIGS. 1 and 2, the shaft of the means of connection have a means for stopping 62 provided for mounting a spring 7 in compression between the means for stopping 62 and the intermediary part 52. The spring is in compression in the service configuration of the riser, i.e. when the latter is, with the shutoff member and the shutoff means for shutting off the first nozzle, both in the shutting-off position such as shown in FIG. 2. As such, when the fusible member of the sprinkler blows, the spring 7 tends to push the shaft of the means of connection downwards, to its untensioned position such as shown in FIG. 1, which causes the displacement of the shutoff means 60 for shutting off the first nozzle 51, in such a way as to release the latter and place into communication the inside of the riser with the pipework (not shown) of the network of sprinklers. In addition, the means of connection bear a stop 63 intended to bear against an intermediate part, here the intermediate part 53, this to retain the shaft when the shutoff member 3 and the means for shutting off 60 are not in shutoff position (FIG. 1).

Moreover, the end section 56 has means for evacuating water comprising:

- an inclined duct 560, extending in an inclined manner rising towards the outside of the end section;
- a ball 561 arranged in the inclined duct;
- a cap 562, screwed onto the inclined duct 560, on the external side of the end section.

The cap 562 itself has a cavity that communicates with the duct 560, and extends in the continuity of the duct 560 with the same inclination.

On the internal side of the end section, the cap 560 has a grid for retaining the ball, through which water can flow. An orifice passes through the head of the cap 560 making it possible to evacuate the water towards the outside of the end section.

As such, in the absence of pressure, the ball is at the bottom 563 of the cavity of the cap (with the ball having a diameter that does not obstruct the passage of water in the bottom position in the cavity of the cap).

In addition, the system of the means for evacuating according to the invention is advantageous in the case of slight leaks between the riser and the duct to which it is connected. Indeed, in the presence of slight leaks (which will not trigger the installation which is provided for in order to re-establish the vacuum in case of leaks that are lower than a predetermined level), the riser will make it possible, through the bottom position 563 of the ball which allows for air to pass to the outside end of the inclined duct, an aspiration that tends to evacuate the water droplets that may be present in the riser.

On the other hand, in the presence of pressure, the ball rises against the head of the cap to top position 564, and is thrust against the orifice that passes through the head of the cap in such a way as to obstruct the latter and prevent the water from flowing.

According to another characteristic of the invention, the sprinkler comprises means for ejecting mounted outside the nozzle 10 and acting in a pulling sense on the shutoff member 3. Of course, as long as the fusible member 2 is in place, the latter exerts a force that is greater than the force of the pulling of the means for ejecting.

Figure 5:
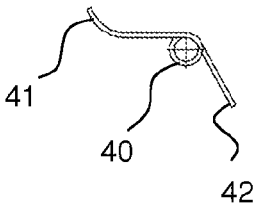
FIGS. 5 to 7 diagrammatically show a torsion spring intended to be provided on a sprinkler of a dry riser according to the invention, respectively viewed from above in untensioned state, viewed from above in tensioned state and viewed from the side.
Figure 6:
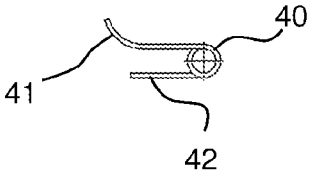
Figure 7:
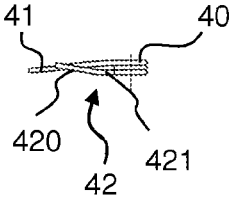

According to this embodiment, the means for ejecting are constituted of a spring, and more precisely a torsion spring 4, such as shown in FIGS. 5 to 7.

Such as shown in these figures, the spring 4 comprises:

- a winding 40, of one or several coils;
- a first limb 41 extending from the winding 40, and intended to cooperate with the shutoff member;
- a second limb extending from the winding 40, and intended to be retained on the sprinkler.

In untensioned state, the spring 4 has a configuration wherein the limbs 41 and 42 are separated from one another, such as shown in FIG. 5, while, in tensioned state, the two limbs 41 and 42 are brought closer to one another, such as shown in FIG. 6. In tensioned state, according to the operating principle of a torsion spring, the limbs 41 and 42 tend to exert a force on the elements that retain them in this position, in order to return to their respective positions that correspond to the untensioned state, such as shown in FIG. 5 in untensioned state.

Such a spring is therefore intended to cooperate via one of its limbs (here limb 41) with the shutoff member for the purpose of ejecting the latter from the sprinkler after the blowing of the fusible member 2.

According to this embodiment, the shutoff member 3 has a flange 31 extending outside the second nozzle 10 and having a flared shape.

The shutoff member 3 is kept bearing against a washer 11 mounted at the end of the nozzle 10. The flared flange 30 of the shutoff member arranges a space 110 with the washer 11.

The spring 4 is mounted on the sprinkler in such a way that one of its limbs (here the limb 41) is placed in the space 110, i.e. between the flared flange 31 and the washer 11 of the sprinkler. More precisely, the space 110 between the flange 31 and the washer 11 is provided in such a way that the corresponding limb of the spring is caught in this space once the fusible member is installed. The spring is therefore kept in complete safety in standby position.

In addition, such as shown in FIGS. 5 et 6, the limb 41 has a curved shape provided to hug the shape of the flange, with the latter having a section of circular shape. As such, it is specified that the washer 11 has a passage of circular shape and that the base 30 of the shutoff member 3 is introduced into the passage of the washer, extending therefore inside the second nozzle 10, until the washer with a flanged, and more precisely tapered, shape, bears against the edges of the passage of the washer, shutting off the latter.

The limb 41 of the spring 4 is therefore inserted into the space 110 between the flange 31 and the washer 11, while the other limb 42 of the spring 4 is kept in a means for retaining that is present on the connector, positioned in such a way that the spring takes of course its tensioned configuration such as shown in FIG. 6.

Figure 4:
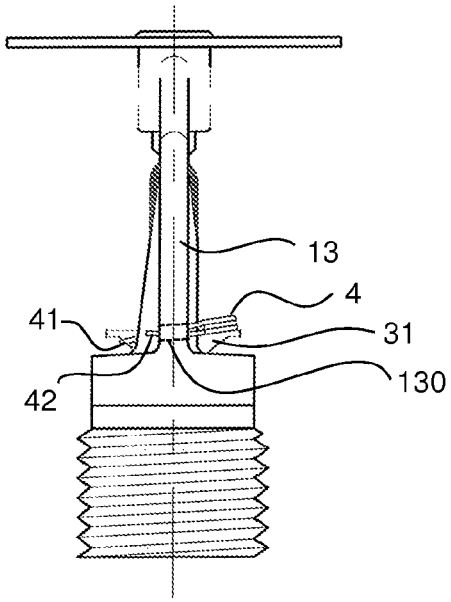

According to this embodiment, this means for retaining takes the form of an orifice 130 arranged at the base of the yoke 13, and intended to be passed through by the limb 42 such as shown in FIG. 4.

Moreover, according to a characteristic of the spring 4 of this embodiment, the limb 42, intended to be inserted into the orifice 130 arranged at the base of the yoke, has two portions, namely:

- a proximal portion 421, at the output of the winding;
- a terminal portion 420, intended to be inserted into the orifice 130 at the base of the yoke, and to pass through the latter.

Such as shown in FIG. 7, the two portions form an elbow in such a way that the terminal portion is able to rise back through the orifice 130 of the yoke, this with respect to the proximal portion (according to the position of the height of the winding with respect to the orifice, it can also be considered that the proximal portion descend with respect to the distal portion once the latter is inserted into the orifice).

An exemplary embodiment of the present disclosure proposes a dry riser for which the design makes it possible to limit the costs of replacement in case of triggering of the latter.

An exemplary embodiment provides such a dry riser for which the maintenance can be executed quickly and easily.

An exemplary embodiment provides such a dry riser that provides, on the sprinkler, a complete release of the nozzle from the connector in the case the fusible member blows.

In this sense, an exemplary embodiment guarantees in all circumstances a minimum triggering time of the actuator of a "vacuum" system.

Although the present disclosure has been described with reference to one or more examples, workers skilled in the art will recognize that changes may be made in form and detail without departing from the scope of the disclosure and/or the appended claims.

The invention claimed is:

1. A dry riser intended to be mounted in a firefighting installation, of the type comprising a network of vacuum sprinklers, with the riser comprising:

an elongate body having at one of its ends a connecting piece for coupling to a pipe, the connecting piece including a first nozzle configured to provide a connection between the riser and the pipe, with the riser including a first shutoff member for shutting off the first nozzle; with the other end of the riser bearing a sprinkler comprising:

- a fixing connector, by which the sprinkler is coupled to the elongate body of the riser, with the fixing connector having a second nozzle;
- a fusible member;
- a second shutoff member for shutting off the second nozzle, held in a shutoff position by the fusible member;
- an ejecting element configured to eject the second shutoff member, the riser further comprising:

- a connection between the first shutoff member that shuts off the first nozzle and the second shutoff member that shuts off the second nozzle, wherein said connection is mobile in such a way as to cause the shutting-off position of the second shutoff member to coincide with a shutting-off position of the first shutoff member of the first nozzle,
- wherein the elongate body has an inclined duct for evacuating water, rising towards an outside of the end section, and including a ball that can allow the water to flow in a bottom position in the inclined duct and prevent the water from flowing in a top position in the inclined duct.

2. The dry riser according to claim 1, wherein the connection includes a shaft, with the body of the riser including a guide, which guides said shaft in longitudinal translation.

3. The dry riser according to claim 2, wherein the first shutoff member that shuts off the first nozzle is secured with an end of said shaft.

4. The dry riser according to claim 2, wherein the guide comprise at least one intermediate part between two sections of the body of the riser, with the part being punched and having a central slide inside of which the shaft is guided in translation.

5. The dry riser according to claim 4, wherein at least one spring is mounted between a means for stopping on the shaft and the intermediate part, with the mounting of the spring being carried out in such a way that the spring is in compression in the shutoff positions of the second shutoff member and the first shutoff member.

6. The dry riser according to claim 4, wherein the shaft bears a stop, which bears against an intermediate part and retains the shaft when the second shutoff member and the first shutoff member are not in the shutoff position.

7. The dry riser according to claim 1, wherein an end section of the elongate body is connected to another section of the elongate body by a punched intermediate part and having a central slide inside of which a shaft is guided in translation.

8. The dry riser according to claim 1, wherein the ejecting element is mounted outside the second nozzle and acts in a pushing sense on the second shutoff member to move the second shutoff member away from the connection.

* * * * *